US010753156B2

(12) United States Patent
Azar

(10) Patent No.: US 10,753,156 B2
(45) Date of Patent: Aug. 25, 2020

(54) CUTTING ELEMENT BACKING SUPPORT

(71) Applicant: Smith International, Inc., Houston, TX (US)

(72) Inventor: Michael G. Azar, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 1364 days.

(21) Appl. No.: 14/838,689

(22) Filed: Aug. 28, 2015

(65) Prior Publication Data

US 2016/0060963 A1 Mar. 3, 2016

Related U.S. Application Data

(60) Provisional application No. 62/044,828, filed on Sep. 2, 2014.

(51) Int. Cl.

| | |
|---|---|
| ***E21B 10/567*** | (2006.01) |
| ***E21B 10/573*** | (2006.01) |
| ***E21B 10/43*** | (2006.01) |

(52) U.S. Cl.

CPC ..... *E21B 10/5673* (2013.01); *E21B 10/43* (2013.01); *E21B 10/5735* (2013.01)

(58) Field of Classification Search

CPC .. E21B 10/5673; E21B 10/43; E21B 10/5735; E21B 10/54; E21B 10/42; E21B 10/567; E21B 10/52

See application file for complete search history.

(56) References Cited

U.S. PATENT DOCUMENTS

| | | | | |
|---|---|---|---|---|
| 4,104,344 | A | 8/1978 | Pope et al. | |
| 4,288,248 | A | 9/1981 | Bovenkerk et al. | |
| 5,127,923 | A | 7/1992 | Bunting et al. | |
| 7,303,030 | B2 | 12/2007 | Lockwood et al. | |
| 2008/0035380 | A1 | 2/2008 | Hall et al. | |
| 2012/0234608 | A9* | 9/2012 | Gavia | E21B 10/43 175/428 |
| 2014/0196959 | A1* | 7/2014 | Hall | E21B 10/5735 175/432 |
| 2014/0353046 | A1* | 12/2014 | Zhang | E21B 10/14 175/331 |

* cited by examiner

*Primary Examiner* — Yong-Suk Ro

(57) ABSTRACT

A cutting tool has a tool body and at least one non-planar cutting element oriented at a forward rake angle on the top surface of the cutting tool. The at least one non-planar cutting element of the cutting tool has a grip region and a non-planar cutting end. A support of the cutting tool extends around at least a portion of a circumference of the grip region.

14 Claims, 12 Drawing Sheets

CUTTING ELEMENT BACKING SUPPORT

CROSS REFERENCE TO RELATED APPLICATION

This Application claims priority to and the benefit of U.S. Provisional Application 62/044,828 filed on Sep. 2, 2014, the entirety of which is incorporated herein by reference.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocked formed in the surface of one of the blades. The cutting elements typically include a hard cutting layer of polycrystalline diamond (PCD) or other superabrasive materials such as thermally stable diamond or polycrystalline cubic boron nitride. For convenience, as used herein, reference to "PDC bit" and "PDC cutters" refers to a fixed cutter bit and cutting element employing a hard cutting layer of polycrystalline diamond or other superabrasive materials.

Referring to FIGS. 1 and 2, a conventional fixed cutter or drag bit 10 adapted for drilling through formations of rock to form a borehole is shown. Bit 10 generally includes a bit body 12, a shank 13, and a threaded connection or pin 14 for connecting the bit 10 to a drill string (not shown) that is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18.

Cutting structure 15 is provided on face 20 of bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of bit 10. However, secondary blades 34, 35, 36 extend radially along bit face 20 from a position that is distal bit axis 11 toward the periphery of bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a planar cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting edge **44*a* farthest from blade tops 42, 52 to which cutting element 40** is mounted.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting tool having a tool body and at least one non-planar cutting element oriented at a forward rake angle on the top surface of the at least one blade, the at least one non-planar cutting element having a grip region and a non-planar cutting end, and a support extending around at least a portion of a circumference of the grip region. The cutting tool may further include at least one blade extending from the tool body, the at least one blade having a leading face, a trailing face opposite the leading face, and a top surface between the leading face and trailing face, and the at least one non-planar cutting element is on the at least one blade.

In another aspect, embodiments disclosed herein relate to a cutting tool having a tool body, at least one blade extending from the tool body, at least one non-planar cutting element disposed on the tool body in a region between at least two blades, where the non-planar cutting element has a grip region, a non-planar cutting end having an apex with a radius of curvature, and a longitudinal axis extending axially through the non-planar cutting element from a base of the grip region and through the apex, and where the non-planar cutting element is oriented on the tool body such that the longitudinal axis is at an angle with respect to a line normal to the tool body and extending at least partially through the non-planar cutting element, and a support extending circumferentially around at least a portion of the grip region.

In yet another aspect, embodiments disclosed herein relate to a method of forming a cutting tool that includes forming a tool body having at least one blade extending therefrom and at least one pocket formed in at least one of the tool body and the at least one blade, the at least one pocket extending into the cutting tool from a pocket opening, forming a support around at least a portion of the pocket opening, and disposing a non-planar cutting element into the pocket opening of one of the at least one pocket, where the non-planar cutting element has a grip region, a non-planar cutting end having an apex with a radius of curvature, and a longitudinal axis extending axially through the non-planar cutting element from a base of the grip region and through the apex, and where the non-planar cutting element is oriented such that the longitudinal axis is at an angle with respect to a line normal to an outer surface of the cutting tool forming the pocket opening and where the line extends at least partially through the non-planar cutting element.

Other aspects and advantages of the claimed subject matter will be apparent from the following description and the appended claims.

DETAILED DESCRIPTION

In one aspect, embodiments disclosed herein relate to fixed cutting drill bits or other downhole cutting tools containing cutting elements with non-planar cutting surfaces. More particularly, some embodiments are directed to downhole cutting tools having cutting elements with non-planar cutting surfaces positioned in a forward or positive rake.

Figure 1:
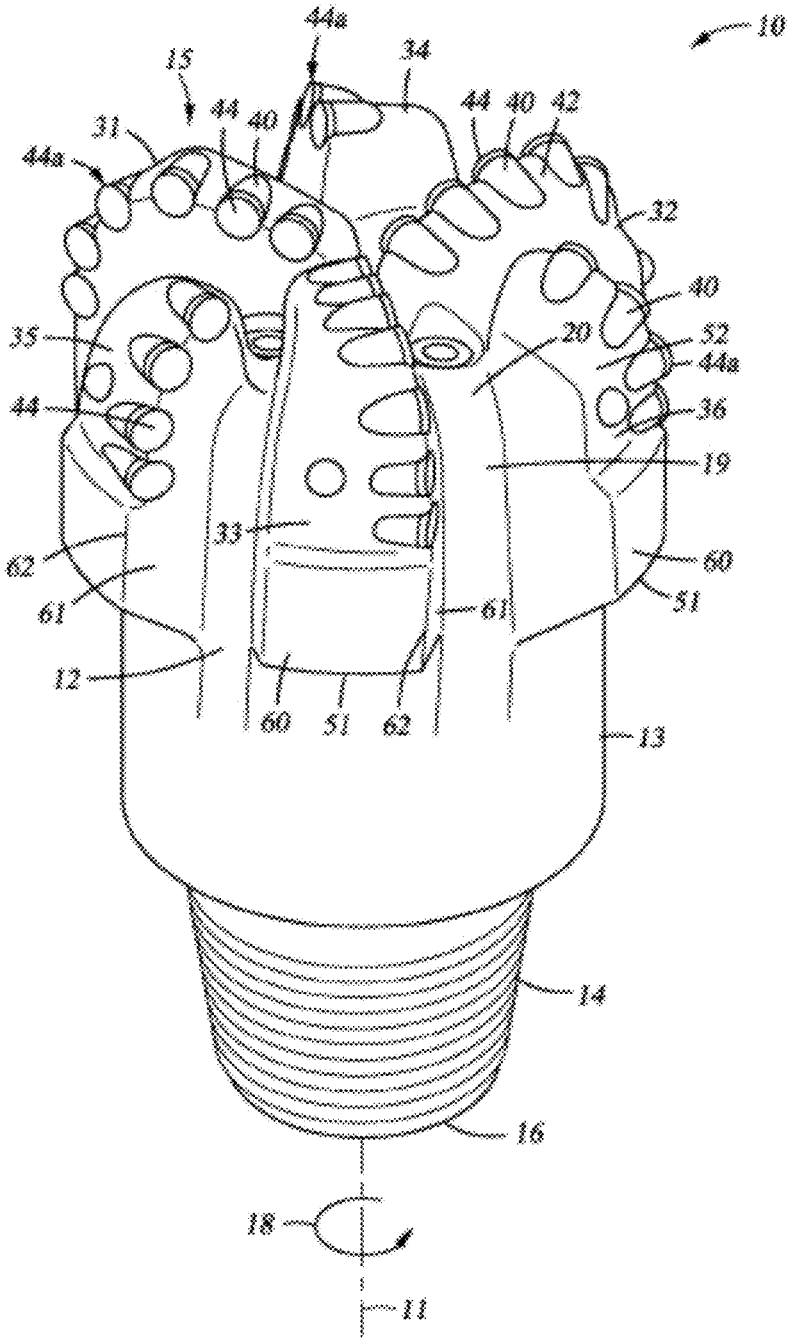
Fig. 1 (PRIOR ART)
FIG. 1 shows a conventional drill bit.
Figure 2:
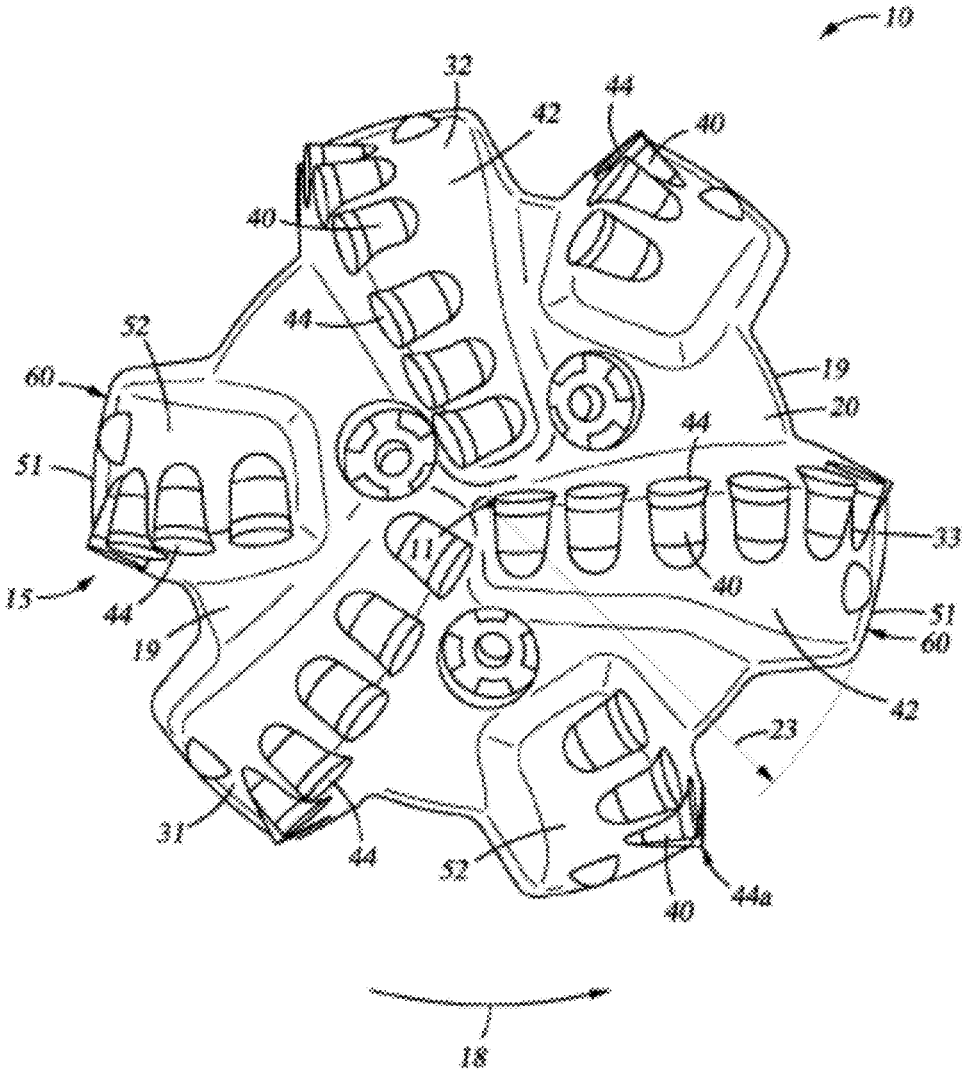
Fig. 2 (PRIOR ART)
FIG. 2 shows a top view of a conventional drill bit.
Figure 3:
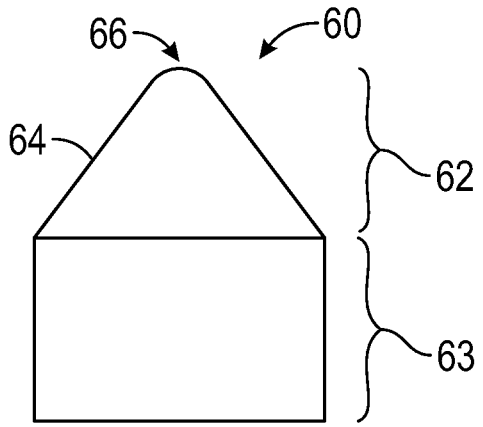
FIGS. 3 and 4 show a side view and cross-sectional view of a conical cutting element.
Figure 4:
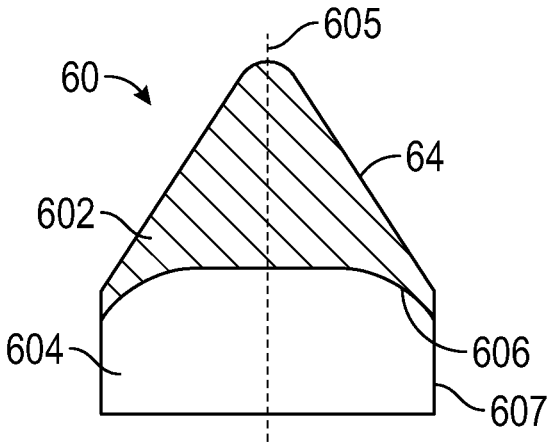
Figure 5:
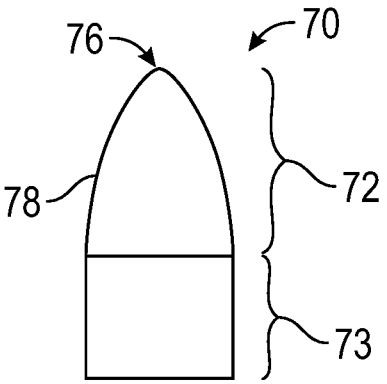
FIGS. 5 and 6 show a side view and a cross-sectional view of a pointed cutting element having a convex side surface.

The term "cutting elements" generically refers to any type of cutting element, while "cutter" refers to those cutting elements with a planar cutting face, as described above in reference to FIGS. 1 and 2, and "non-planar cutting elements" refers to those cutting elements having a non-planar cutting face, such as a generally pointed cutting end, e.g., having a cutting end terminating in an apex, which may include, for example, cutting elements having a conical cutting end (shown in FIGS. 3-4) or cutting elements having a bullet shape (shown in FIGS. 5-6), for example. As used herein, the term "conical cutting elements" refers to cutting elements having a generally conical cutting end 62 (including either right cones or oblique cones), e.g., a conical side wall 64 that terminates in a rounded apex 66, as shown in FIGS. 3-4. Conical cutting elements could include geometric cones that terminate at a sharp point apex, geometric cones that terminate at a flat top, or elements having an apex having curvature between the side surfaces and the apex. Further, in one or more embodiments, a bullet cutting element 70 may be used. The term "bullet cutting element" refers to cutting element having, instead of a generally conical side surface, a generally convex side surface 78 terminated in a rounded apex 76. In one or more embodiments, the apex 76 has a substantially smaller radius of curvature than the convex side surface 78. However, it is also intended that the non-planar cutting elements of the present disclosure may also include other non-planar cutting end shapes having an apex, including, for example, a concave side surface terminating in a rounded apex, shown in FIG. 7. In each of such embodiments, the non-planar cutting elements may have a smooth transition between the side surface and the rounded apex (e.g., the side surface or side wall tangentially joins the curvature of the apex), but in some embodiments, a non-smooth transition may be present (e.g., the tangent of the side surface intersects the tangent of the apex at a non-180 degree angle, such as for example ranging from about 120 to less than 180 degrees).

Non-planar cutting elements according to embodiments of the present disclosure are not limited to conical cutting elements and may also include other non-planar shapes. In some embodiments, non-planar elements that may be used with the supports described herein may be those which have an axis that is inserted into the drilling tool substantially parallel with the axis of rotation of the drilling tool (e.g., elements that have no back rake or have a forward rake or back rake that is +/−45 degrees, such as zero to 35 degrees, from zero to 20 degrees, from zero to 10 in other embodiments, or from greater than or equal to 5).

The apex of a non-planar cutting element may have curvature, including a radius of curvature. In one or more embodiments, the radius of curvature may range from about 0.050 to 0.125. One or more other embodiments may use a radius of curvature ranging from a lower limit of any of 0.050, 0.060, 0.075, 0.085, or 0.100 to an upper limit of any of 0.075, 0.085, 0.095, 0.100, 0.110, or 0.125, where any lower limit can be used with any upper limit. In some embodiments, the curvature may have a variable radius of curvature, a portion of a parabola, a portion of a hyperbola, a portion of a catenary, or a parametric spline.

Further, in one or more embodiments, the non-planar cutting elements may include any pointed or otherwise non-planar cutting end shape having an cutting end extending above a grip or base region, where the cutting end extends a height that is at least 0.25 times the diameter of the cutting element, or at least 0.3, 0.4, 0.5 or 0.6 times the diameter in one or more other embodiments (e.g., the cutting end extends a height that is in a range of between 0.25 and 0.75 times the diameter of the cutting element). As used herein, a cutting end may include the side surface and rounded apex forming the non-planar working surface. According to some embodiments, a cutting end may be formed of an ultrahard material, such as diamond, diamond composite, polycrystalline diamond, thermally stable polycrystalline diamond (formed either by treatment of polycrystalline diamond formed from a metal catalyst such as cobalt or polycrystalline diamond formed with a metal having a lower coefficient of thermal expansion than cobalt), polycrystalline cubic boron nitride, or combinations of ultrahard material, which may be attached to or formed on a substrate forming the grip or base region.

Figure 6:
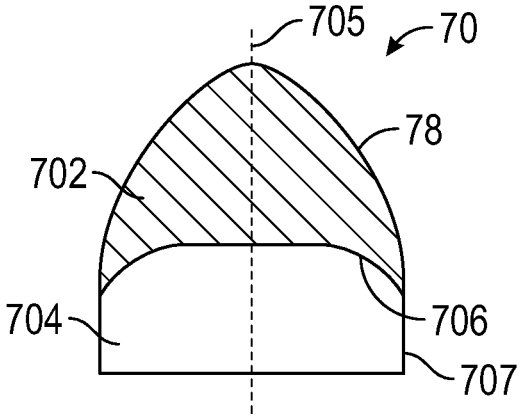
Figure 7:
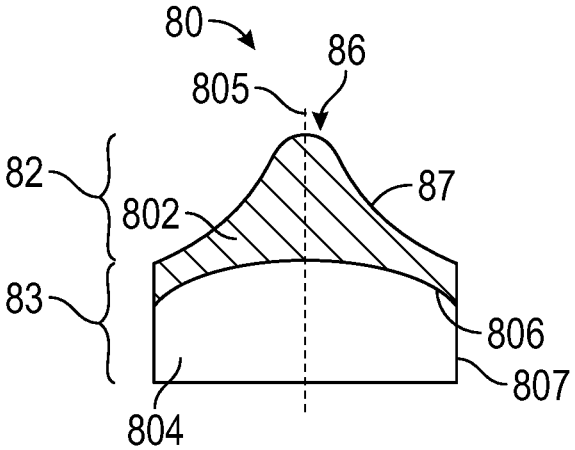
FIG. 7 shows a cross-sectional view of a pointed cutting element having a concave side surface.

For example, as shown in FIGS. 4, 6 and 7, non-planar cutting elements possess a diamond layer 602, 702, 802 on a substrate 604, 704, 804 (such as a cemented tungsten carbide substrate), where the diamond layer 602, 702, 802 forms a non-planar diamond working surface. Non-planar cutting elements may be formed in a process similar to that used in forming diamond enhanced inserts (e.g., used in roller cone bits) or by brazing components together. Non-planar cutting elements 60, 70, 80 may be provided on, for example, a drill bit, reamer, or other cutting tool according to embodiments of the present disclosure.

The diamond layer 602, 702, 802 may be made of polycrystalline diamond ("PCD") materials. PCD may be formed by subjecting diamond particles in the presence of a suitable solvent metal catalyst material to processing conditions of high pressure/high temperature (HPHT), where the solvent metal catalyst promotes desired intercrystalline diamond-to-diamond bonding between the particles, thereby forming a PCD structure. Particularly, a microstructure of conventionally formed PCD material includes a plurality of diamond grains that are bonded to one another to form an intercrystalline diamond matrix first phase. The catalyst/binder material, e.g., cobalt, used to facilitate the diamond-to-diamond bonding that develops during the sintering process is dispersed within the interstitial regions formed between the diamond matrix first phase. The catalyst/binder material used to facilitate diamond-to-diamond bonding can be provided generally in two ways. The catalyst/binder can be provided in the form of a raw material powder that is pre-mixed with the diamond particles or grit prior to sintering. In some embodiments, the catalyst/binder can be provided by infiltration into the diamond material (during high temperature/high pressure processing) from an underlying substrate material to which the final PCD material is to be bonded. After the catalyst/binder material has facilitated the diamond-to-diamond bonding, the catalyst/binder material is generally distributed throughout the diamond matrix within interstitial regions formed between the bonded diamond grains, where the binder material is not continuous throughout the microstructure in the conventional PCD material, but rather, the microstructure of the conventional PCD material may have a uniform distribution of binder among the PCD grains, including diamond grain/binder interfaces and diamond grain/diamond grain interfaces. The term "particle" refers to the powder employed prior to sintering a superabrasive material, while the term "grain" refers to discernable superabrasive regions subsequent to sintering, as known and as determined in the art. The resulting PCD structure produces enhanced properties of wear resistance and hardness, making such PCD materials extremely useful in aggressive wear and cutting applications where high levels of wear resistance and hardness are desired.

The metal catalyst, such as cobalt, used to promote recrystallization of the diamond particles and formation of the lattice structure of polycrystalline diamond may be leached to form thermally stable polycrystalline diamond. Examples of "leaching" processes can be found, for example, in U.S. Pat. Nos. 4,288,248 and 4,104,344. Briefly, a strong acid, such as hydrofluoric acid or combinations of several strong acids, may be used to treat the diamond table, removing at least a portion of the catalyst from the PDC composite. Suitable acids include, for example, nitric acid, hydrofluoric acid, hydrochloric acid, sulfuric acid, phosphoric acid, or perchloric acid, or combinations of these acids. In addition, caustics, such as sodium hydroxide and potassium hydroxide, have been used by the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923.

In some embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the non-catalyst binder may react with the diamond lattice to form a carbide, such as silicon carbide when using a silicon non-catalyst binder, which may also have a thermal expansion similar to diamond. However, one of ordinary skill in the art would recognize that a thermally stable diamond layer may be formed by other methods known in the art, including, for example, by altering processing conditions in the formation of the diamond layer, such as by increasing the pressure to above 50 kbars with a temperature of above 1350 degrees C.

In some embodiments, the diamond grade (i.e., diamond powder composition including grain size and/or metal content) may be varied within a diamond layer. For example, in one or more embodiments, the region of diamond layer adjacent the substrate may differ in material properties (and diamond grade) as compared with the region of the diamond layer at the apex of the cutting element. Such variation may be formed by a plurality of step-wise layers or by a gradual transition.

Referring again to FIGS. 3-7, the interface 606, 706, 806 between diamond layer 602, 702, 802 and substrate 604, 704, 804 may be non-planar or non-uniform, for example, to aid in reducing incidents of delamination of the diamond layer 602, 702, 802 from substrate 604, 704, 804 when in operation and to improve the strength and impact resistance of the element. The interface may include one or more convex or concave portions, as known in the art of non-planar interfaces. Additionally, use of some non-planar interfaces may allow for greater thickness in the diamond layer in the tip region of the layer. Further, it may be desirable to create the interface geometry such that the diamond layer is thickest at a zone that encompasses the primary contact zone between the diamond enhanced element and the formation. Additional shapes and interfaces that may be used for the cutting elements of the present disclosure include those described in U.S. Patent Publication No. 2008/0035380. In some embodiments, non-planar cutting elements may have a planar interface between an ultra-hard material body forming the non-planar cutting end and a substrate. In one or more embodiments, the diamond layer 602, 702, 802 may have a thickness of 0.100 to 0.500 inches (2.54 to 12.7 mm) from the apex to the central region of the interface with the substrate, or in other embodiments, such thickness may range from 0.125 to 0.275 inches (3.175 to 6.985 mm). However, other sizes and thicknesses may also be used.

As used herein, a non-planar cutting end of a non-planar cutting element refers to the pointed end of the non-planar cutting element and is defined by the non-planar working surface, while a grip region refers to the remaining region of the non-planar cutting element axially adjacent the non-planar cutting end. As shown in FIGS. 3-7, a non-planar cutting element 60, 70, 80 may include a non-planar cutting end 62, 72, 82 defined by the non-planar working surface (including the side surface 64, 78, 87 and apex 66, 76, 86) and a grip region 63, 73, 83. The non-planar cutting end 62, 72, 82 extends from the grip region 63, 73, 83 and is formed of a portion of diamond body 602, 702, 802. The grip region 63, 73, 83 may be substantially cylindrical and is formed from the substrate 604, 704, 804 and the remaining portion of the diamond body 602, 702, 802. Thus, in the embodiments shown, the diamond body forms both the non-planar cutting end and a portion of the grip region of the non-planar cutting element. However, in other embodiments, a grip region may be formed entirely of a substrate, and the non-planar cutting end formed entirely of a diamond body. In yet other embodiments, a grip region may be formed of a combination of materials, for example, one or more substrate materials such as transition metal carbides, one or more transition layers including varying ratios of carbide and diamond mixtures, or a combination of substrate material, one or more transition layers, and a portion of the material also forming the non-planar cutting end.

Further, according to embodiments of the present disclosure, a non-planar cutting element may include a substantially cylindrical grip region and a pointed non-planar cutting end. In other embodiments, a non-planar cutting element may include a grip region with a non-cylindrical shape. For example, a grip region may have a curved base surface or a tapered base end, where the base surface and base end are opposite the cutting end of the cutting element. In some embodiments, a grip region may include the region of the non-planar cutting element defined by one or more outer side surfaces substantially parallel with a central longitudinal axis of the non-planar cutting element. For example, as shown in FIGS. 3-7, the grip regions 63, 73, 83 are defined by the outer side surface 607, 707, 807 of each non-planar cutting element 60, 70, 80 that is parallel with the central longitudinal axis 605, 705, 805 of each non-planar cutting element. The cross sectional shape of the grip region 63, 73, 83 along a plane perpendicular to the longitudinal axis 605, 705, 805 and defined by the outer side surface 607, 707, 807 may be circular, thereby forming a cylindrically shaped grip region 63, 73, 83. In other embodiments, a cross sectional shape of a grip region may be non-circular, e.g., elliptical or polygonal.

According to embodiments of the present disclosure, a non-planar cutting element may be disposed on a cutting tool at an angle relative to the cutting tool, where a support is disposed around a portion of the non-planar cutting element. The support may extend an axial length along the non-planar cutting element from the surface of the cutting tool to cover a portion of the non-planar cutting element. For example, a cutting tool may have a tool body with at least one blade extending therefrom and at least one pocket formed in the tool body, one or more blades, or both the tool body and one or more blades, where a non-planar cutting element is disposed partially within a pocket and oriented in a positive back rake. The non-planar cutting element may have a grip region, a non-planar cutting end having an apex with a radius of curvature and a longitudinal axis extending axially through the non-planar cutting element from a base of the grip region and through the apex, where a portion of the grip region is disposed in the pocket. A support may be formed or machined around at least a portion of the pocket, such that when the non-planar cutting element is positioned in the pocket, the support extends an axial length along the non-planar cutting element from the surface of the cutting tool and circumferentially around at least a portion of the grip region.

Non-planar cutting elements may be oriented at a positive or forward back rake on a downhole cutting tool, such as a drill bit, a reamer, or other hole opening tool, and may be disposed in various regions of the cutting tool, such as along a blade or in a coring region, depending on, for example, the type of cutting tool and formation being drilled. Generally, when positioning cutting elements on a blade of a cutting tool, the cutting elements may be inserted into pockets, or holes, to change the angle at which the cutting element strikes the formation. Specifically, the back rake (i.e., a vertical orientation) and the side rake (i.e., a lateral orientation) of a cutting element may be adjusted.

Figure 8:
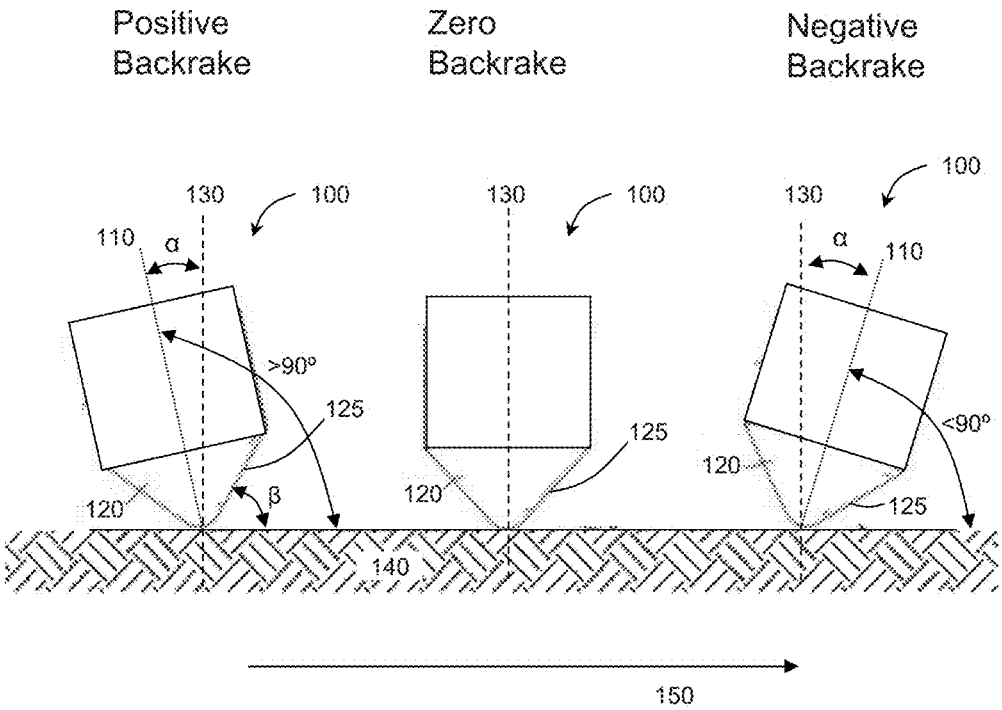
FIG. 8 shows non-planar cutting elements at a negative, zero and positive back rake.

When considering the orientation of cutting elements having non-planar cutting ends, in addition to the vertical or lateral orientation of the cutting element body, the geometry of the non-planar cutting end also affects how and the angle at which the non-planar cutting element strikes the formation. Specifically, in addition to the back rake affecting the aggressiveness of the cutting end-formation interaction, the cutting end geometry (specifically, the apex angle and radius of curvature) greatly affect the aggressiveness that the non-planar cutting element attacks the formation. In the context of a non-planar cutting element, as shown in FIG. 8, back rake may be defined as the angle $\alpha$ formed between the axis of the non-planar cutting element 100 (specifically, the axis 110 of the non-planar cutting end 120) and a line 130 that is normal to the formation material 140 being cut. As shown in FIG. 8, with a non-planar cutting element 100 having zero back rake, the axis 110 of the non-planar cutting element 100 is substantially perpendicular or normal to the formation material 140. A non-planar cutting element 100 having negative back rake angle $\alpha$ has an axis 110 that engages the formation material 140 at an angle that is less than 90° as measured from the formation material 140. Similarly, a non-planar cutting element 100 having a positive back rake angle $\alpha$ has an axis 110 that engages the formation material at an angle that is greater than 90° when measured from the formation material 140.

In addition to the orientation of the axis with respect to the formation, the aggressiveness of non-planar cutting elements may also be dependent on the apex angle or specifically, the angle between the formation and the leading portion of the non-planar cutting element. In some embodiments, a leading line of a non-planar cutting surface may be determined to be the firstmost points at each axial point along the side surface of the non-planar cutting end surface as the bit rotates. Said in another way, a cross-section may be taken of a non-planar cutting element along a plane in the direction 150 of the rotation of the bit, as shown in FIG. 8. The leading line 125 of the non-planar cutting element 100 in such plane may be considered in relation to the formation 140. The strike angle of a non-planar cutting element 100 is defined to be the angle $\beta$ formed between the leading line 125 of the non-planar cutting element 100 and the formation 150 being cut. The strike angle will vary depending on the back rake and the shape and angle of the leading line from the apex, and thus, the strike angle of the non-planar cutting element may be calculated to be the back rake angle less one-half of the angle of the leading line (i.e., $\beta$=(0.5*leading line angle)+$\alpha$). In some embodiments, $\beta$ may range from about 5 to 100 degrees, or from about 20 to 65 in other embodiments.

In a particular embodiment, the back rake angle of the non-planar cutting elements may be positive. In some embodiments, the back rake of the non-planar cutting elements may range from zero to 35 degrees, from zero to 20 degrees, from zero to 10 in other embodiments, or from greater than or equal to 5 in yet other embodiments. Further, while not necessarily specifically mentioned in the following paragraphs, the back rake angles of the non-planar cutting elements in the following embodiments may be selected from these ranges.

Further, non-planar cutting elements may have a positive, negative or zero side rake. Side rake is defined as the angle formed between the axis of the non-planar cutting element (specifically, the axis extending through the apex of the non-planar cutting end) and a line parallel to the tool centerline, i.e., z-axis. A non-planar cutting element having zero side rake may have an axis extending through the apex of a non-planar cutting end that is substantially parallel to the tool centerline. A non-planar cutting element having positive side rake angle may have an axis extending through the apex of a non-planar cutting end that is pointed away from the direction of the tool centerline. Conversely, a non-planar cutting element having a negative side rake angle may have an axis extending through the apex of a non-planar cutting end that points towards the direction of the tool centerline. The side rake of the non-planar cutting elements may range from about −30 to 30 in various embodiments and from −10 to 10 in other embodiments.

Figure 9:
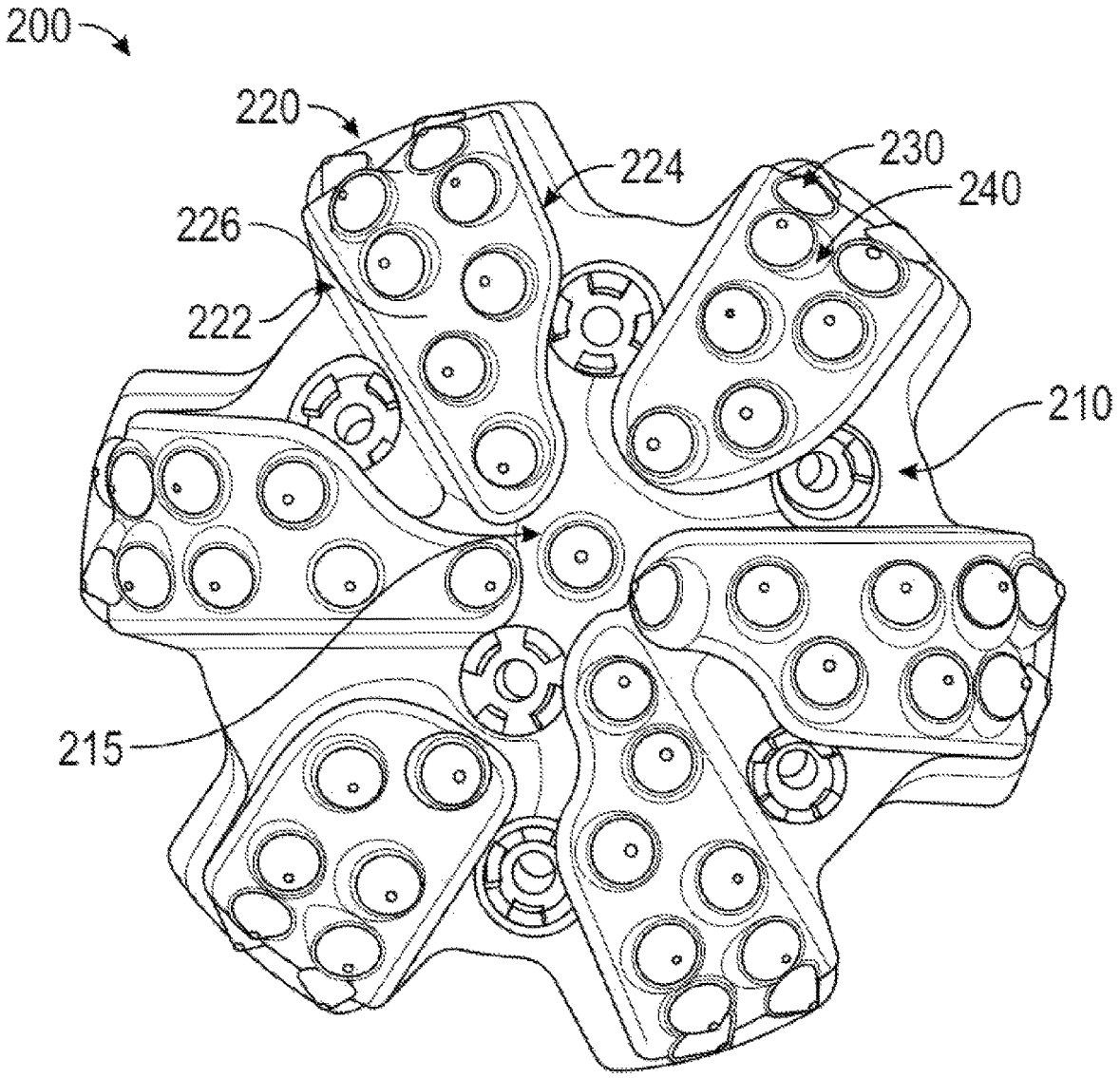
FIG. 9 shows a drill bit according to embodiments of the present disclosure.

FIG. 9 shows an example of a cutting tool according to embodiments of the present disclosure having a tool body, a plurality of blades extending from the tool body, at least one non-planar cutting element oriented at a forward back rake angle on a top surface of the blade, and a support extending circumferentially around a portion of each non-planar cutting element. The cutting tool 200 is a drill bit having a bit body 210, an axis of rotation extending axially through the bit body, and a plurality of blades 220 extending azimuthally from the bit body 210 and converging towards a central region 215 of the bit body. Each blade 220 has a leading face 222, facing in the direction of bit rotation, a trailing face 224 opposite the leading face, and a top surface 226 facing radially outward and extending between the leading face 222 and trailing face 224. At least one non-planar cutting element 230 may be oriented at a forward or positive back rake angle on the top surface 226 of the blade 220, where the non-planar cutting elements have a grip region and a non-planar cutting end, such as described above. For example, the forward back rake angle of one or more non-planar cutting elements may be greater than or equal to 5 degrees. A support 240 is disposed on the top face 226 of the blade and extends around at least a portion of each non-planar cutting element.

Figure 13:
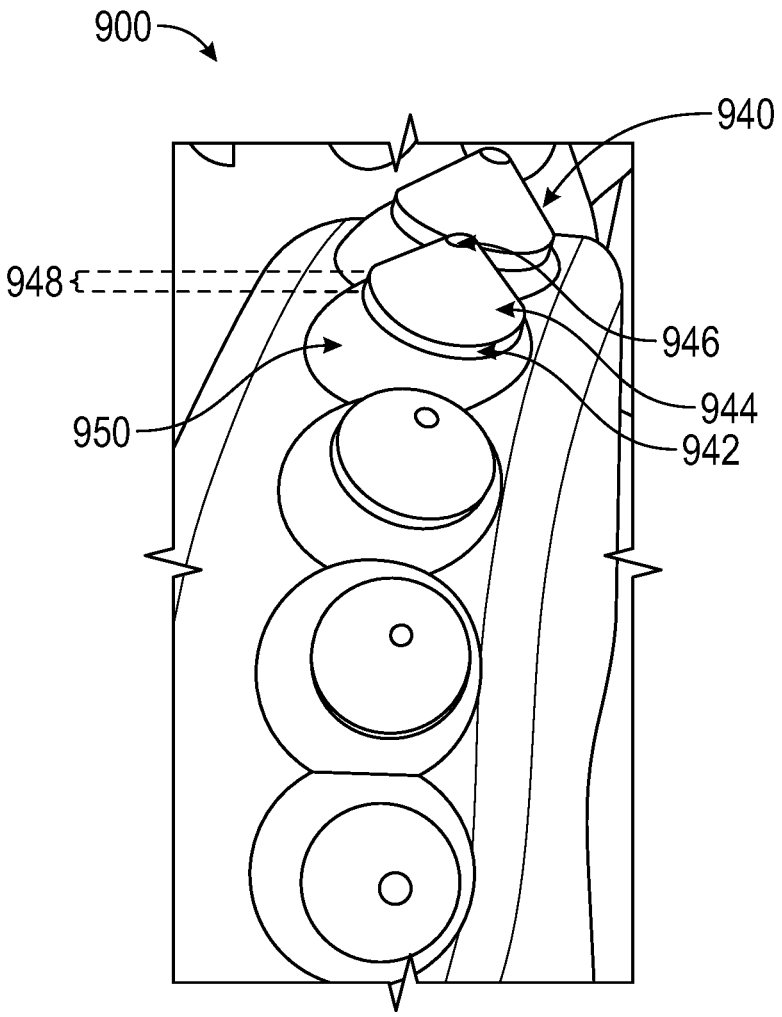
FIG. 13 shows a plurality of a non-planar cutting element disposed on a blade, according to methods of the present disclosure.

As shown, two rows of cutting elements 230 are disposed on each blade 220, including a row of primary cutting elements, closest to the leading face 222 of each blade, and a row of secondary cutting elements, positioned rearward of the primary cutting elements and closest to the trailing face 224 of each blade. However, in other embodiments, more than two rows or less than two rows (e.g., one row of cutting elements, such as shown in FIG. 13) may be disposed on one or more blades. In yet other embodiments, non-planar cutting elements may be disposed in a pattern or other locations along the blade that does not form a row. Further, one or more non-planar cutting elements may be a primary cutting element or a back up cutting element to a primary cutting element. As used herein, the term "primary cutting element" may be used to refer to a cutting element that does not trail any other cutting element on the same blade, and the term "back up cutting element" may be used to refer to a cutting element that trails another cutting element disposed on the same blade when the cutting tool is rotated in the cutting direction. Additionally, non-planar cutting elements may share a radial position from a central axis of the cutting tool with one or more other cutting elements, located either on the same blade or a different blade. In other words, a non-planar cutting element may be located at a radial distance from the central axis of the cutting tool, and at least one other cutting element may be located at the same radial distance from the central axis, on the same or different blade. However, according to embodiments of the present disclosure, one or more non-planar cutting elements may have a radial position that is different than the radial positions of the remaining cutting elements on the cutting tool. In some embodiments, each cutting element may be at a different radial position (i.e., the radial distance from the cutting tool's central axis), at least one non-planar cutting element may be at the same radial position as another cutting element on the cutting tool, or each non-planar cutting element may share a radial position with at least one other cutting element on the cutting tool.

Figure 10:
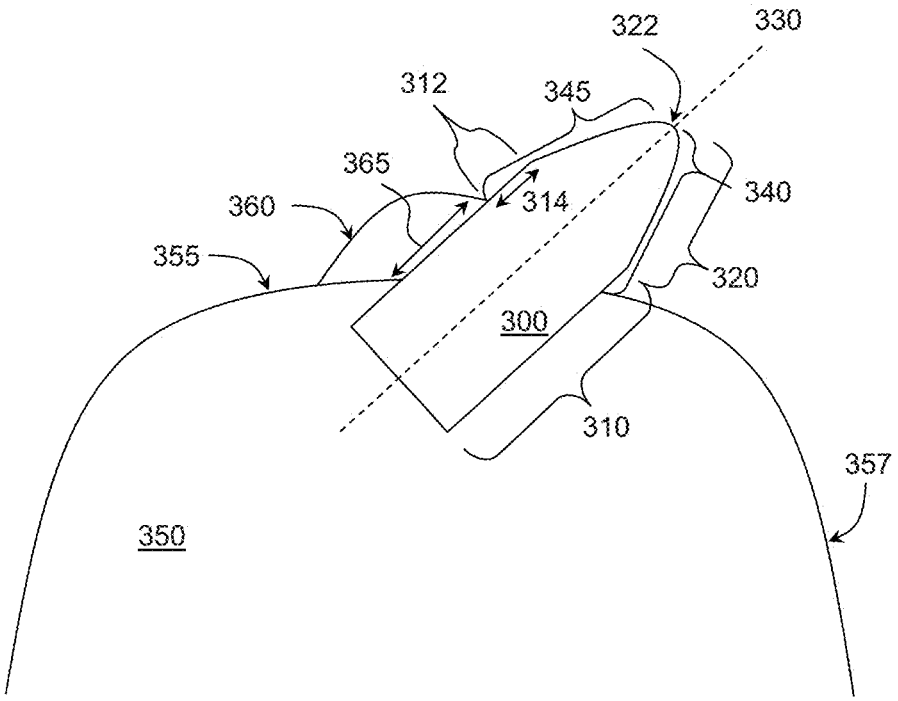
FIG. 10 shows a cross-sectional view of a non-planar cutting element disposed on a blade, according to embodiments of the present disclosure.

Referring now to FIG. 10, a cross sectional view of a non-planar cutting element 300 disposed at a positive back rake on a cutting tool blade 350 is shown, where a support 360 surrounds a portion of the non-planar cutting element grip region, according to embodiments of the present disclosure. The non-planar cutting element 300 has a grip region 310, a non-planar cutting end 320 having an apex 322 with a radius of curvature, and a longitudinal axis 330 extending axially through the cutting element and through the apex 322. The non-planar cutting element 300 is oriented at a positive back rake, where the apex 322 is pointed partially towards the leading face 357 of the blade, in the direction of cutting. In the embodiment shown, the non-planar cutting element 300 has a cylindrically shaped grip region 310, where the non-planar cutting end 320 has an outer surface that extends from the side surface of the grip region at an angle and converges towards the apex 322. The support 360 may extend around a portion of the circumference of the grip region 310, or a support may extend around the entire circumference of the grip region. According to some embodiments of the present disclosure, a support may extend at least 120 degrees around the circumference of a grip region of a non-planar cutting element. In some embodiments, a support may extend circumferentially around the grip region of a non-planar cutting element ranging from greater than 120 degrees, from 120 degrees to 180 degrees in some embodiments, or greater than 180 degrees and up to 270 degrees or 360 degrees around the grip region in some embodiments.

Non-planar cutting element 300 may have a minimum total exposure 340 along the front side of the cutting element (the side of the non-planar cutting element facing the leading face 357) and a maximum total exposure 345 along the back side of the cutting element (the side of the non-planar cutting element opposite the front side and facing the trailing face of the blade). The minimum total exposure 340 is measured between the apex 322 of the non-planar cutting element 300 and the top surface 355 of the blade. According to embodiments of the present disclosure, a minimum total exposure of a non-planar cutting element may be equal to the height of the non-planar cutting element minus the axial length of the grip region plus the exposure length of the exposed portion along the front side of the cutting element, where the exposure length may be about 1/32 inch (0.79 mm) in some embodiments, greater than about 1/32 inch (0.79 mm) in some embodiments, or less than about 1/32 inch (0.79 mm) in some embodiments (as described more below).

Further, the support 360 extends an axial length 365 along the grip region 310 from the top surface 355 of the blade 350 to an exposed portion 312 of the grip region 310. According to embodiments of the present disclosure, at least a portion of the exposed portion 312 may have an exposure length 314 greater than or equal to about 1/32 inch (0.79 mm) or greater than about 1/16 inch (1.59 mm) in some embodiments. For example, in some embodiments, two opposing portions around the grip region (at about 180 degrees apart along the circumference of the grip region) may be exposed, where each opposing region has an exposure length greater than or equal to about 1/32 inch (0.79 mm). In such embodiments, the support may extend less than 180 degrees around the circumference of the grip region, where each opposing surface has an exposure length extending to the surface of the blade, or the support may extend 180 degrees or more around the circumference of the grip region, where at least one of the opposing surfaces has an exposure length extending to the support.

An exposed portion of a grip region may provide an area of the non-planar cutting element that may be gripped, for example, to maneuver during brazing, replacement of the non-planar cutting element, or to rotate the non-planar cutting element. However, it can be appreciated that in other embodiments, an exposed portion may have an exposure length less than about 1/32 inches, or in some embodiments, the entire grip region may be covered by the pocket and the support, thus leaving no exposed portion of the grip region. In some embodiments, a portion around the circumference or outer periphery of a grip region may be entirely covered by the pocket and/or a support such that there is no exposed portion of the grip region along the portion, while the remaining portion around the circumference or outer periphery of the grip region has an exposed portion (i.e., the support extends axially along the remaining portion of the grip region from the pocket opening to the exposed portion).

Figure 14:
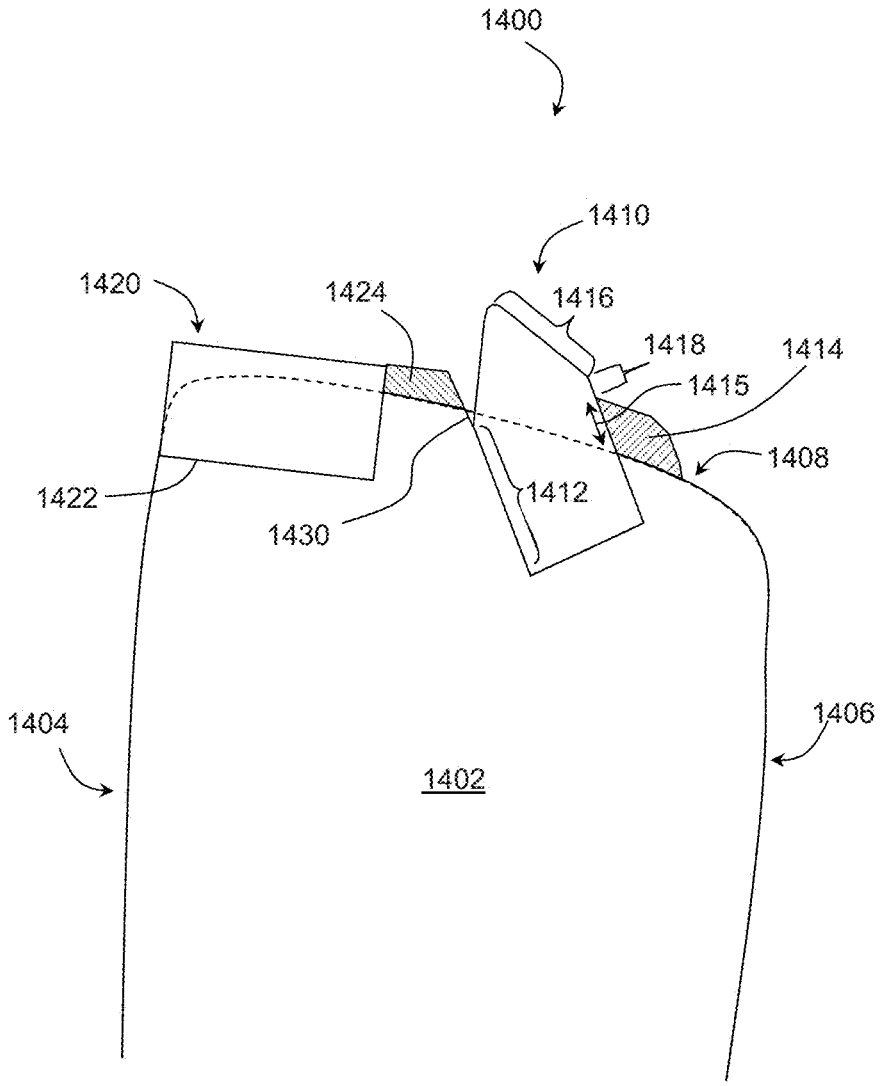
FIG. 14 shows a cross section view of a cutting tool according to embodiments of the present disclosure.

In some embodiments a cutting tool includes at least one non-planar cutting element oriented in a forward back rake, where a portion around the circumference of the non-planar cutting element grip region is covered along its entire axial length, i.e., there is no exposed portion of the grip region along the portion of the grip region circumference. Thus, the grip region of the cutting element has an exposed portion extending around less than the entire circumference of the grip region. FIG. 14 shows a cross sectional view of such a cutting tool.

Referring to FIG. 14, the cutting tool 1400 has at least one blade 1402 with a leading face 1404 (facing in the direction of rotation), a trailing face 1406 (opposite the leading face) and a top surface 1408 extending between the leading face 1404 and trailing face 1406. A plurality of cutting elements 1420 (e.g., planar cutting elements) are disposed in cutter pockets 1422 formed at the leading edge of the blade (along the intersection of the leading face 1404 and top surface 1408). A plurality of non-planar cutting elements 1410 are disposed in pockets 1430 formed along the top surface 1408 of the blade, between the cutter pockets 1422 and the trailing face 1406 of the blade. A first support 1424 is formed rearward of one or more cutting elements 1420 and a second support 1414 is formed around a portion of one or more non-planar cutting elements 1410. The first supports 1424 and the second supports 1424 may be formed of the same or different material as each other and may be formed of the same or different material as the blade. The second support 1414 extends around a portion of the circumference of the grip region 1412 and an axial length 1415 along the grip region 1412 from the top surface 1408 of the blade 1402 to an exposed portion 1418 of the grip region 1412. At least one of the non-planar cutting elements 1410 is oriented in a forward back rake along the blade 1402 such that a portion of the grip region 1412 along its entire axial length is covered by the pocket 1430, or in some embodiments, the entire axial length of a portion of the grip region is covered by the pocket and the first support. As shown, a front side of the non-planar cutting element 1410 (the side of the non-planar cutting element facing the leading face 1404) may be covered entirely by the pocket 1430 in which the non-planar cutting element 1410 is disposed, where a portion of the cutting face 1416 is lower than the blade top surface 1408, and thus also lower than the first support 1424.

In other embodiments, the front side of a cutting face of a non-planar cutting element (oriented at a forward back rake) may be at the same axial position as the blade top surface, and may or may not be lower than an adjacent support. In other embodiments, the front side of a cutting face of a non-planar cutting element (oriented at a forward back rake) may be higher than the blade top surface and any adjacent support. Further, according to embodiments of the present disclosure, a portion around a non-planar cutting element periphery may be covered along its entire axial length by the pocket in which the non-planar cutting element is disposed, or covered along its entire axial length by a combination of the pocket and a support, while a remaining portion around the non-planar cutting element periphery has an exposed portion.

A support may be made of a matrix material including, for example, one or more transition metal carbides, such as tungsten carbide, or other composites of hard particles and a metal binder. A support may be made of the same material as the cutting tool (its tool body and/or blades) to which it is attached or formed. For example, a support may be attached to or formed on a blade of a cutting tool, where both the support and the blade are made of a matrix material having the same composition. In some embodiments, a support may be made of a different material than the cutting tool (its tool body and/or blades) to which it is attached or formed.

According to some embodiments, supports may be attached to a cutting tool surface, such as the tool body surface or a blade surface, for example, by welding. In some embodiments, a support may be formed with the cutting tool (during formation of the cutting tool), or a support may be machined into a cutting tool surface. In such embodiments, the support is formed integrally with the cutting tool, and may be made of the same or different material as the cutting tool. For example, in some embodiments having a support machined into a cutting tool surface, e.g., a blade top surface or other cutting tool body surface, the support may be formed of the same material as the adjacent portion of the cutting tool. In some embodiments having a support formed with the cutting tool, a mold having the negative shape of the cutting tool with support may be filled with a matrix material and infiltrated to form the cutting tool and support integrally together. The portion of the mold corresponding to the support may be filled with the same material as the remaining portions of the mold, thereby forming a support integrally with the cutting tool and having the same material composition as at least a portion of the cutting tool, or the portion of the mold corresponding to the support may be filled with a different material than the remaining portions of the mold, thereby forming a support integrally with the cutting tool and with a different material than the cutting tool. For example, a first matrix material may be loaded into the portions of the mold corresponding to the supports and a second matrix material may be loaded into portions of the mold corresponding to the blades and/or tool body, where the first matrix material is harder than the second matrix material. Different matrix materials loaded into a support portion of a mold and adjacent portions of the mold may have one or more property difference therebetween, including, for example, hardness, toughness and/or wear resistance, resulting from, for example, the different matrix materials having the same composition and different particles sizes or from having different compositions. Further, in embodiments having a different matrix material loaded into a support portion of a mold than the matrix material filling the adjacent portion(s) of the mold, the support matrix material and the adjacent cutting tool matrix material may both be infiltrated with the same infiltration binder during the infiltration process of forming the cutting tool.

Further, a support may or may not have a hardfacing material disposed thereon. A hardfacing material may be applied, such as by arc or gas welding, to an outer surface of a cutting tool on which a support is formed, where the hardfacing material covers at least a portion of the outer surface and/or at least a portion of the support. For example, a cutting tool having a steel blade with one or more supports machined into the blade top surface may have hardfacing applied to the entire blade top surface, including the one or more supports. Hardfacing material may include, for example, selected combinations of one or more metal carbides, e.g., tungsten, molybdenum, tantalum, niobium, chromium, or vanadium carbides, one or more metal alloy binders, one or more ultrahard materials, such as cubic boron nitride, diamond particles or coated ultrahard material particles, and/or filler material. Hardfacing materials known in the art, for example, as described in U.S. Pat. No. 7,303,030, may be applied to the outer surface and/or support of a cutting tool.

According to embodiments of the present disclosure, a cutting tool may have a non-planar cutting element disposed on its tool body, where a support extends circumferentially around at least a portion of the grip region of the non-planar cutting element. For example, referring again to FIG. 9, cutting tool 200 has a tool body 210, at least one blade 220 extending from the tool body and a non-planar cutting element 250 disposed on the tool body in a region between at least two blades 220. As shown, the blades 220 extend azimuthally along the tool body 210 and converge at the central region 215, where the non-planar cutting element 250 is disposed on the tool body in the central region 215. However, in other embodiments, depending on the type of cutting tool, a non-planar cutting element may be disposed on the tool body in other regions between two or more blades. Further, the non-planar cutting element 250 has a grip region, a non-planar cutting end having an apex with a radius of curvature, and a longitudinal axis extending axially through the non-planar cutting element from a base of the grip region and through the apex. The non-planar cutting element 250 is oriented on the tool body 210 such that the longitudinal axis is at an angle with respect to a line normal to the tool body and extending at least partially through the non-planar cutting element. Stated in a different way, the non-planar cutting element 250 may be disposed at an angle relative to the surrounding tool body surface such that the area of the grip region outside the pocket on one side is larger than the area of the grip region outside the pocket on an opposite side.

Figure 11:
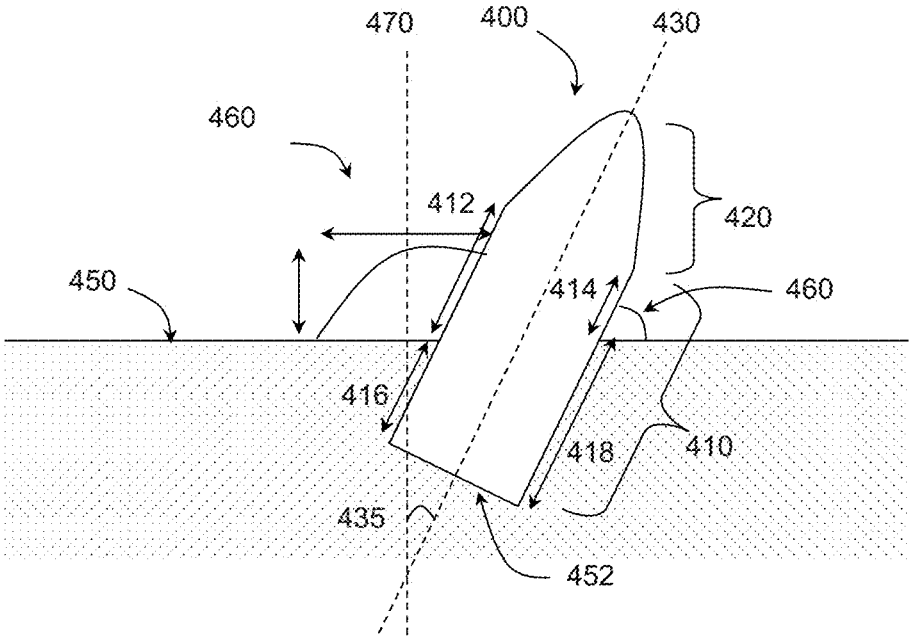
FIG. 11 shows a cross-sectional view of a non-planar cutting element disposed on a tool body, according to embodiments of the present disclosure.

For example, referring now to FIG. 11, a cross-sectional view of a non-planar cutting element 400 disposed on a tool body 450 at an angle relative to the surrounding tool body surface is shown. The non-planar cutting element 400 has a grip region 410, a non-planar cutting end 420 having an apex with a radius of curvature, and a longitudinal axis 430 extending axially through the non-planar cutting element from a base of the grip region and through the apex. The non-planar cutting element 400 is disposed within a pocket 452 formed in the tool body 450 and oriented such that the longitudinal axis 430 is at an angle 435 with respect to a line 470 normal to the tool body 450 and extending at least partially through the non-planar cutting element 400. The area 412 of the grip region outside the pocket 452 on a first side is larger than the area 414 of the grip region outside the pocket 452 on an opposite side. Likewise, the area 416 of the grip region within the pocket 452 and on the first side is smaller than the area 418 of the grip region within the pocket 452 on the opposite side.

A support 460 extends circumferentially around a portion of the grip region outside the pocket 452. As shown, the support 460 may be applied around the grip region having a varied axial length along the grip region 410, measured from the outer surface of the tool body 450 (at the opening to the pocket) to an exposed portion of the grip region 410. Thus, although the areas 412, 414 outside the pocket 452 on opposite sides have different axial lengths, the varied axial length of coverage of the support 460 may provide an exposed portion of the grip region having a substantially uniform exposure length around the grip region. However, according to other embodiments of the present disclosure, both the axial length of the support and the exposure length of the exposed portion may vary around at least a portion of the circumference of the grip region. In yet other embodiments, a support may have a substantially uniform axial length and an exposed portion may have a varied exposure length around at least a portion of the circumference of the grip region.

According to some embodiments of the present disclosure, a support may be defined in terms of its change in height and change in width. For example, referring to FIG. 16, a support 1700 according to embodiments of the present disclosure extends at least partially around a non-planar cutting element 1710. The support 1700 has a width 1702 measured in a first direction extending radially from the non-planar cutting element 1710, where the width is measured between the two widest apart points 1701, 1703 along the first direction, and a height 1704 measure in a second direction perpendicular to the first direction and extending from an adjacent portion of the cutting tool 1720, where the height 1704 is measured between the two points 1701, 1703 having the greatest difference in height along the second direction. In the embodiment shown, the two points 1701, 1703 having the greatest difference in height are also the widest apart points 1701, 1703. In other embodiments, at least one of the points having the greatest difference in height may be different than the widest apart points. The height 1704 of support 1700 varies along its width 1702 and the width 1702 of the support 1700 varies along its height 1704. According to embodiments of the present disclosure, a support may have a height that varies continuously or non-continuously along its width and a width that varies continuously or non-continuously along its height.

Figure 15:
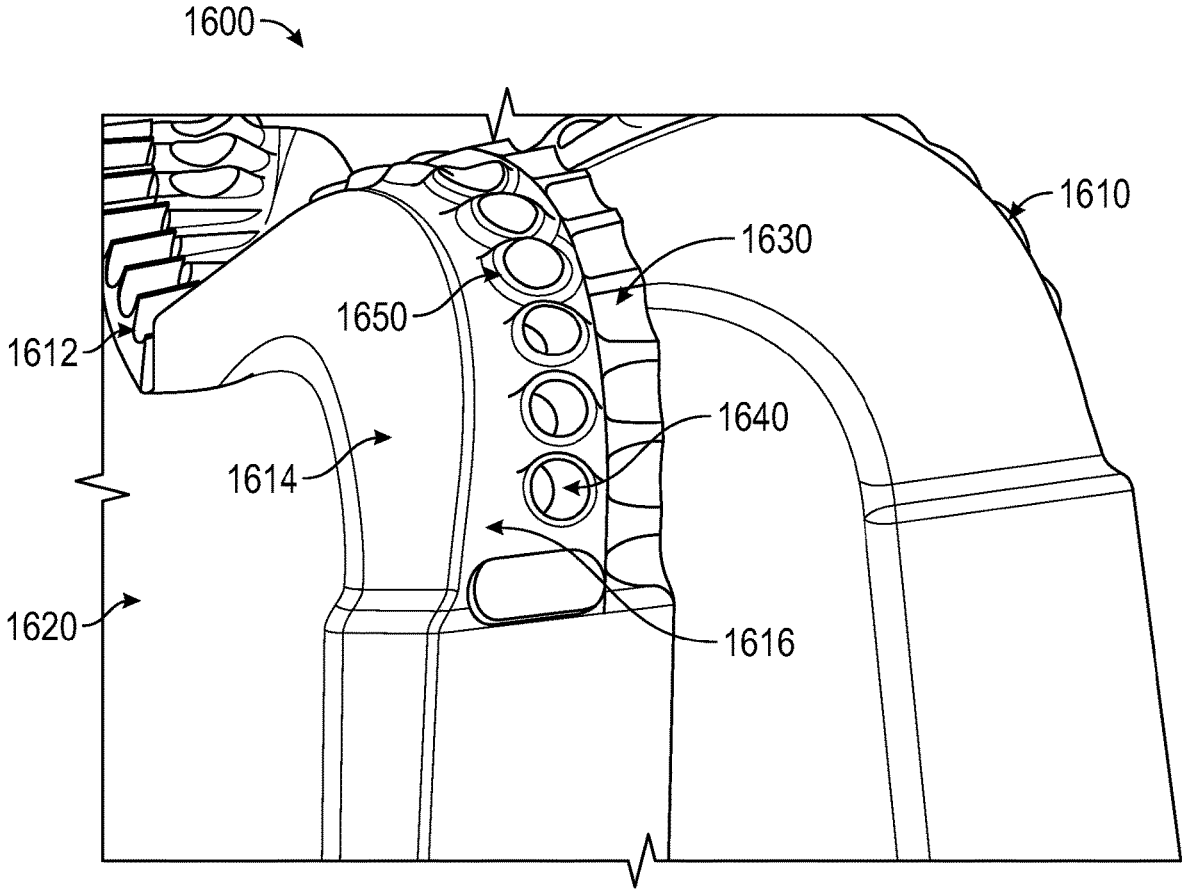
FIG. 15 shows a perspective view of a cutting tool having pockets formed therein.

According to embodiments of the present disclosure, the widest part of a support 1700 may have a width 1702 that ranges from a lower limit of ⅛, ¼, ½, or ¾ the diameter (or widest dimension) of the non-planar cutting element 1710 grip region (and thus the diameter of the pocket in which the non-planar cutting element is disposed) to an upper limit of ¾, 1 times, or 1.5 times the diameter (or widest dimension) of the non-planar cutting element 1710 grip region. In some embodiments, the widest part of a support may have a width that is less than ⅛ the diameter (or widest dimension) of the pocket it at least partially surrounds, such as shown in FIG. 15. Defining a support in terms of its height and/or width may be useful for embodiments having a support formed integrally with and formed of the same material as an adjacent portion of a cutting tool blade or body. In embodiments having a support formed of a different material than the adjacent portion of a cutting tool blade or body, the support may be defined by the volume of its material composition and/or in terms of its change in height and width.

Figure 16:
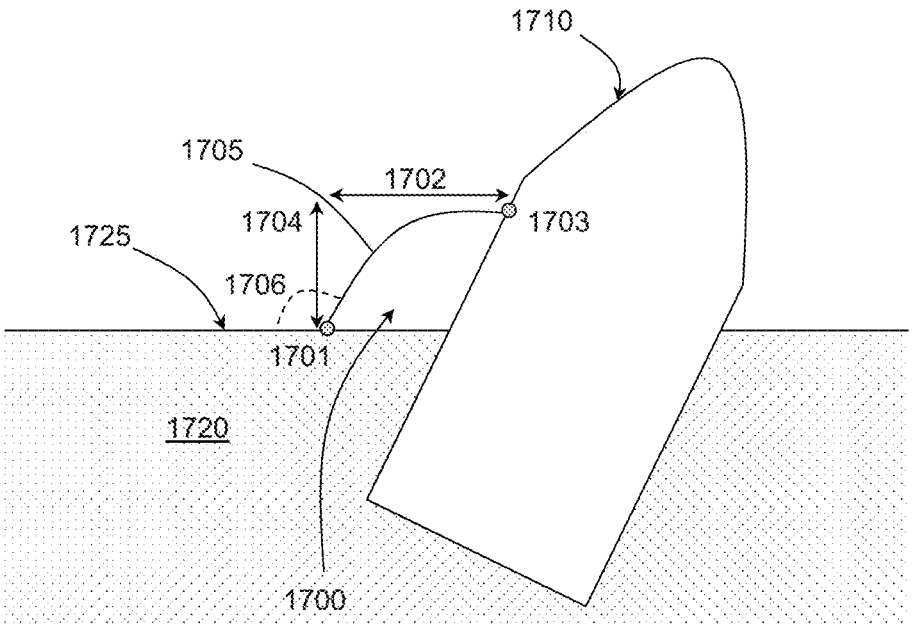
FIG. 16 shows a cross-sectional view of a non-planar cutting element disposed on a tool body, according to embodiments of the present disclosure.

Further, according to some embodiments, a support may be defined along its outermost periphery (i.e., the radially outermost distance from the non-planar cutting element), where the outermost periphery is formed by an angular intersection of adjacent surfaces having different slopes. For example, as shown in FIG. 16, the radially outermost point 1701 of the support 1700 from the non-planar cutting element 1710 (forming part of the support's outermost periphery) is formed by the intersection of the support outer surface 1705 and the adjacent cutting tool surface 1725, where the slope of the support outer surface 1705 adjacent the intersection is different from the slope of the cutting tool surface 1725 adjacent the intersection. According to embodiments of the present disclosure, the support outer surface 1705 may intersect the adjacent cutting tool surface 1725 at an angle 1706 ranging from 90 degrees to less than 160 degrees, from greater than 90 degrees to less than 135 degrees, or from greater than 90 degrees to less than 120 degrees. In other embodiments, the support outer surface may have a rounded transition to the adjacent cutting tool surface. In yet other embodiments, a portion around a support's outer periphery may have a rounded transition between the support outer surface and the adjacent cutting tool surface, while the remaining portions around the support's outer periphery may have an angled intersection between the support outer surface and the adjacent cutting tool surface.

Cutting tools according to embodiments of the present disclosure may be made by forming a tool body having at least one blade extending therefrom and at least one pocket formed in at least one of the tool body and the at least one blade. The pocket may extend inwardly from an outer surface of the tool body or one or more blades, or both the tool body and one or more blades at an angle relative to the surrounding outer surface, where the angle may range up to or less than 90 degrees. A support may be formed at least partially around one or more pockets during formation of the cutting tool or after formation of the cutting tool. Methods of forming downhole cutting tools may include, for example, machining, infiltration, pressing and sintering, and combinations thereof, as well as others known in the art.

For example, one such method of forming a drill bit having a bit body and a plurality of blades extending radially therefrom may include providing a mold of the drill bit, where cutting element displacements are positioned along the bottom of the mold in the locations and orientations desired for the pockets eventually formed, loading a matrix material into the mold and over the displacements (and around any other preformed components, such as components of the drill bit made of a different material or blanks), and infiltrating the matrix material with an infiltration binder. The mold may be shaped to include a negative space of a support extending at least partially around one or more of the displacements. The negative space of the support may be filled with the same or different matrix material as the remaining portions of the mold. An infiltrant, or metallic binder material, may be placed over the matrix powder packed in the mold, and the components within the mold are then heated in a furnace to the flow or infiltration temperature of the infiltrant, at which point the melted infiltrant infiltrates the powdered matrix material in the mold, including the material in the support portion of the mold. Once cooled, the infiltrant material may form a binder phase of the matrix material. The infiltration process that occurs during heating bonds the grains of matrix material to each other and to the other components to form a solid bit body that is relatively homogeneous throughout. The matrix powder may be a powder of a single matrix material such as tungsten carbide, or it may be a mixture of more than one matrix material such as different forms of tungsten carbide, e.g., macrocrystalline tungsten carbide, cast tungsten carbide, carburized (or agglomerated) tungsten carbide, or cemented tungsten carbide. In some embodiments, non-tungsten carbides of vanadium, chromium, titanium, tantalum, niobium, silicon, aluminum, or other transition metal carbides may be used. In yet other embodiments, carbides, oxides, or nitrides of Group IVA, VA, or VIA metals may be used. Matrix materials used may include hard particles having a monomodal bimodal or mixture of different particle sizes. Further, a matrix powder may include additional components such as metal additives. A binder phase may be formed from a powder component mixed in with the powdered matrix material and/or from an infiltrating component, such as cobalt, nickel, iron, chromium, copper, molybdenum, their alloys, or combinations thereof. For example, in some embodiments, a graphite mold may be packed with a tungsten carbide powder, which may then be infiltrated with a molten copper-based alloy infiltrant. Once the matrix material is formed into the drill bit shape through the molding process, the displacements may be removed to reveal the cutting element pockets and surrounding supports.

In some embodiments a blade and/or portions of a tool body may be formed of steel or other machinable material, where cutting element pockets may be machined into the material along an angle relative to the surrounding outer surface and a support may be machined into the surface around one or more pockets. For example, at least a portion of a blade and/or tool body may be formed of steel having 0.15-0.35% carbon by weight, from 0.15-0.2% carbon by weight, or 0.25-0.35% carbon by weight.

A few methods of forming downhole cutting tools are mentioned above; however, other methods of forming downhole cutting tools may be used, as well, where pockets are formed therein to receive cutting elements and a support is formed at least partially around one or more of the pocket openings. According to embodiments of the present disclosure, at least one pocket may be formed in a cutting tool body and/or at least one blade of a cutting tool, where the pocket extends inwardly a depth into the cutting tool at an angle corresponding with the back rake angle of a non-planar cutting element to be eventually inserted, and a support may be formed at least partially around one or more of the pocket openings.

Further, in methods of the present disclosure, a non-planar cutting element may be inserted into a pocket formed on the cutting tool. The non-planar cutting element may include a grip region, a non-planar cutting end having an apex with a radius of curvature, and a longitudinal axis extending axially through the non-planar cutting element from a base of the grip region and through the apex. The non-planar cutting element (and corresponding pocket) may be oriented such that the longitudinal axis of the non-planar cutting element is at an angle with respect to a line normal to the surface forming the pocket opening. In other embodiments, the angle of orientation of the non-planar cutting element (and corresponding pocket) may be measured, as described above, with respect to back rake angle, strike angle or with respect to the portion of the cutting tool to which the non-planar cutting element is attached.

According to some embodiments, the direction of back rake (i.e., positive/forward back rake, zero back rake, or negative back rake) of a non-planar cutting element may be determined in relation to the direction of rotation of the cutting tool to which the non-planar cutting element is disposed. For example, as discussed above, a non-planar cutting element may have a grip region and a non-planar cutting end (having an apex with a radius of curvature), where at least a portion of the grip region is disposed within a pocket formed in the cutting tool. Generally, non-planar cutting elements having a positive back rake may be pointed (specifically, the apex may be pointed) at least partly in the direction of rotation of the cutting tool, while non-planar cutting elements having a negative back rake may be pointed at least partly in the opposite direction of rotation of the cutting tool. In such cases, the grip regions of non-planar cutting elements oriented in a positive or negative back rake may also have varied exposure of its outer surface from the pocket and any surrounding support. In other words, a grip region of a non-planar cutting element oriented in a positive or negative back rake may have an exposed portion with varying lengths along the grip region.

Referring now to FIG. 15, a partially manufactured cutting tool made according to embodiments of the present disclosure is shown. The cutting tool 1600 is a drill bit having a plurality of blades 1610 extending from a bit body 1620, where each blade 1610 has a leading face 1612, facing in the direction of bit rotation, a trailing face 1614 opposite the leading face 1612, and a blade top surface 1616 extending between the leading face and the trailing face. A plurality of cutter pockets 1630 are formed along the leading edge of each blade 1610 and a plurality of pockets 1640 (for receiving non-planar cutting elements) are formed along the top surface 1616 of each blade. A support 1650 is formed at least partially around each of the pockets 1640. However, in some embodiments, a support may be formed at least partially around less than each of the pockets, for example, around one or more pocket of each blade, around pockets in selected regions of a blade, or around one or more pockets formed in one or two or more selected blades, such as primary blades or secondary blades.

The supports 1650 are formed on the blades 1610 integrally with the cutting tool 1600. For example, the supports 1650 may be formed integrally with the blades 1610 by forming the bit in using a mold having the negative shape of the bit, including negative support spaces formed along the negative blade spaces. Displacements may be disposed along the portion of the negative blade space that are to eventually become pockets 1640 and cutter pockets 1630 and adjacent to the negative support spaces where supports 1650 are to be eventually formed around pockets 1640. One or more matrix powder types (i.e., one or more different compositions of matrix powders, e.g., different transition metal carbides, different types of tungsten carbide such as sintered tungsten carbide and/or cast tungsten carbide, or different mixtures of transition metal carbide types and/or ultrahard material particles) may be loaded over the displacements to fill the mold, where the matrix powder filling the negative support spaces is the same composition or different composition than the matrix powder filling the negative blade space. An infiltration binder may then be infiltrated through the matrix powder and cooled to form the cutting tool 1600 shown in FIG. 15.

In other embodiments, the cutter pockets 1630, the pockets 1640 and/or the supports 1650 may be machined or milled into each blade 1610. For example, in some embodiments, a drill bit (or other cutting tool) may be formed by machining the geometry of a plurality of blades extending from a tool body. The blade thickness, height, axial extension along the tool body, radial curvature around the tool body, leading face geometry, trailing face geometry, to name a few, may be machined according to a predetermined design of the cutting tool. One or more cutter pockets may be machined into the leading edge of one or more blades, and one or more vertical holes (extending partially a depth into the height of the blade) may be drilled or machined into a blade top surface at a predetermined orientation to form pockets 1640. The blade top surface may then be machined to form a support 1650 around one or more of the pockets 1640. The amount of material machined or removed along the blade top surface to define the supports may be designed to reduce contact of the blade top surface with a formation being drilled while also leaving an amount of material to form a support that covers a portion of a non-planar cutting element according to embodiments of the present disclosure.

Non-planar cutting elements may be inserted and attached into pockets 1640 and cutting elements may be attached to cutter pockets 1630. Various methods of attaching cutting elements may be used, including, for example, brazing and interference fitting. Further, a hardfacing material may be applied over the supports 1650 and/or blade top surface 1616 either before or after a non-planar cutting element is attached to the pocket.

While embodiments described above include methods of forming a support integrally with a cutting tool, according to some embodiments, a support may be attached to the tool surface. For example, according to some embodiments, after a non-planar cutting element is inserted into a pocket, a support may be attached (e.g., welded or brazed) around at least a portion of the grip region of the non-planar cutting element. According to some methods of the present disclosure, a support may be attached to the cutting tool to at least partially cover a portion of the grip region outside the pocket by depositing the support material in molten form to the cutting tool surface adjacent the non-planar cutting element. In some embodiments, a support may be welded to the cutting tool surface adjacent the non-planar cutting element. A non-planar cutting element may be inserted into a pocket either before or after a support is attached or formed on the cutting tool. A non-planar cutting element may be attached to a pocket by methods known in the art, for example, by brazing or by interference fitting. Further, a hardfacing material may be applied over a support and/or cutting tool outer surface either before or after a non-planar cutting element is attached to the pocket.

Figure 12:
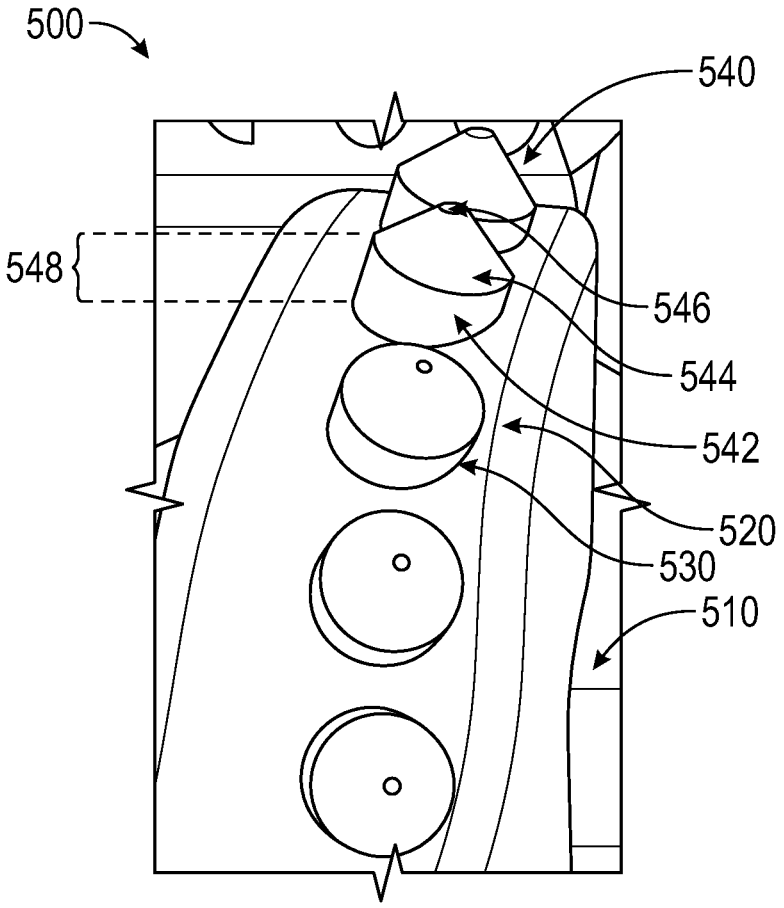
FIG. 12 shows a plurality of non-planar cutting elements disposed on a blade.

FIGS. 12 and 13 show a comparison of a cutting tool having non-planar cutting elements at a forward back rake without an adjacent support and a cutting tool according to embodiments of the present disclosure having non-planar cutting elements at a forward back rake with an adjacent support. Referring first to FIG. 12, a cutting tool 500 may be provided or formed having a tool body 510, at least one blade 520 extending outwardly therefrom, and at least one pocket 530 formed in at least one of the tool body 510 and the at least one blade 520, the at least one pocket 530 extending into the cutting tool from a pocket opening. A non-planar cutting element 540 is inserted through the pocket opening and into pocket 530. The non-planar cutting elements 540 have a grip region 542, a non-planar cutting end 544 having an apex 546 with a radius of curvature, and a longitudinal axis extending axially through the non-planar cutting element from a base of the grip region and through the apex 546. The non-planar cutting elements 540 are oriented such that the longitudinal axis is at an angle with respect to a line normal to an outer surface of the cutting tool forming the pocket opening and where the line extends at least partially through the non-planar cutting element, such as shown in FIG. 11.

Referring still to FIG. 12, pockets 530 are formed in blade 520 to receive non-planar cutting elements 540 at a forward/positive back rake angle. The non-planar cutting elements 540 disposed on the blade 520 may be oriented at a forward rake angle that is greater than or equal to 5 degrees. Upon being inserted into the pocket 530, an area 548 of the grip region remains outside the pocket 530, where the area 548 on one side of the grip region 542 is larger than the area on an opposite side of the grip region 542. The apex 546 of each non-planar cutting element 540 is pointed partially in the direction the cutting tool rotates during cutting, where the smaller area 548 also faces in the direction of rotation.

As shown in FIG. 13, a support 950 may be formed or machined around at least a portion of the a pocket opening having a non-planar cutting element disposed therein, where the support 950 extends axially along the grip region 942 of the non-planar cutting element from the surface of the cutting tool blade 920 to an exposed portion 948 of the grip region 942. At least a portion of the exposed portion 948 of the grip region 942 may have an exposure length of about 1/32 inch to about 1/8 inch (0.79 mm to 3.18 mm) or greater than or equal to about 1/32 inch (0.79 mm). In some embodiments, an exposed portion of a grip region may have an exposure length greater than or equal to about 1/16 inch (1.59 mm). Further, in the embodiment shown, the support 950 extends around the entire circumference of the grip region 942. However, in other embodiments, a support may extend less than the entire circumference of the grip region. For example, a support may extend between 100 and 180 degrees around the grip region, or between 120 and 180 degrees around the grip region, or between 180 and 360 degrees around the grip region, depending on, for example, the area of the grip region remaining outside the pocket and the angle of cutting element orientation.

According to some methods of the present disclosure, a non-planar cutting element may be maneuvered after the support is attached to the cutting tool. For example, in some embodiments, the exposed portion of the grip region of a non-planar cutting element may be gripped, for example using pliers or other gripping tool, and then maneuvered based on the function to be performed. For example, a non-planar cutting element may be rotated within the pocket by gripping an exposed portion of the grip region and rotating the non-planar cutting element. In some embodiments, a non-planar cutting element may be removed from the pocket by gripping an exposed portion of the grip region, for example, to replace or repair the non-planar cutting element. In some embodiments, the exposed portion of the grip region of a non-planar cutting element may be gripped and maneuvered for handling while brazing the non-planar cutting element.

By providing an exposed portion on opposite sides of a grip region of a non-planar cutting element, the non-planar cutting element may be gripped and maneuvered. Further, supports of the present disclosure may allow improved protection and performance of non-planar cutting elements oriented in positive back rake angles. For example, by providing a support around at least a portion of the grip region, the grip region may be at least partially protected from wear or drilling muds during drilling operations.

Although just a few example embodiments have been described in detail above, those skilled in the art will readily appreciate that many modifications are possible in the example embodiments without materially departing from the apparatus, systems, and methods disclosed herein. Accordingly, such modifications are intended to be included within the scope of this disclosure. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function. Each addition, deletion, and modification to the embodiments that fall within the meaning and scope of the claims is to be embraced by the claims.

What is claimed is:

1. A cutting tool, comprising:

a tool body;

at least one non-planar cutting element oriented at a forward rake angle on the cutting tool, the at least one non-planar cutting element having a grip region and a non-planar cutting end;

at least one blade extending from the tool body, the at least one blade having a leading face, a trailing face opposite the leading face, and a top surface between the leading face and the trailing face, and the at least one non-planar cutting element is located on the at least one blade; and a support extending around at least a portion of a circumference of the grip region, wherein the support extends an axial length along the grip region of the at least one non-planar cutting element from the top surface of the at least one blade.

2. The cutting tool of claim 1, wherein the non-planar cutting element is located rearward a primary cutting element in a rotational direction of the cutting tool, and wherein the primary cutting element and the non-planar cutting element are on the same blade.

3. The cutting tool of claim 1, wherein the support and the at least one blade are made of a matrix material having the same composition.

4. The cutting tool of claim 1, wherein the support is made of a matrix material different than the at least one blade.

5. The cutting tool of claim 1, wherein the support extends an axial length along the grip region from the top surface of the at least one blade to an exposed portion of the grip region.

6. The cutting tool of claim 5, wherein at least a portion of the exposed portion has an exposure length greater than or equal to 1/32 inch.

7. The cutting tool of claim 1, wherein the non-planar cutting element is a primary cutting element.

8. The cutting tool of claim 1, wherein the forward rake angle is greater than or equal to 5 degrees.

9. The cutting tool of claim 1, wherein the support extends at least 120 degrees around the circumference of the grip region.

10. The cutting tool of claim 1, wherein two opposing portions around the grip region are exposed, each opposing portion having an exposure length greater than or equal to 1/32 inch.

11. A cutting tool, comprising:

a tool body;

at least one blade extending from the tool body;

at least one non-planar cutting element on the tool body in a region between at least two blades, the at least one non-planar cutting element comprising:

a grip region;

a non-planar cutting end having an apex; and a longitudinal axis extending axially through the at least one non-planar cutting element from a base of the grip region and through the apex, the at least one non-planar cutting element being oriented on the tool body such that the longitudinal axis is at an angle with respect to a line normal to the tool body and extending at least partially through the at least one non-planar cutting element; and a support extending circumferentially around at least a portion of the grip region.

12. The cutting tool of claim 11, wherein the cutting tool is a drill bit having a bit body and a plurality of blades extending azimuthally from the bit body and converging towards a central region of the bit body, and wherein one of the at least one non-planar cutting element is disposed in a central region of the bit body.

13. The cutting tool of claim 11, wherein the support extends at least 120 degrees around a circumference of the grip region.

14. The cutting tool of claim 11, wherein at least a portion of an exposed portion of the grip region has an exposure length greater than or equal to 1/32 inch.

* * * * *